United States Patent [19]

Brandeau

[11] 4,155,613

[45] May 22, 1979

[54] MULTI-PAIR FLAT TELEPHONE CABLE WITH IMPROVED CHARACTERISTICS

[75] Inventor: Edward P. Brandeau, Willimantic, Conn.

[73] Assignee: Akzona, Incorporated, Asheville, N.C.

[21] Appl. No.: 756,222

[22] Filed: Jan. 3, 1977

[51] Int. Cl.[2] ..... H01R 11/02; H01B 7/08; H01B 11/08

[52] U.S. Cl. ..... 339/29 R; 174/36; 174/117 F; 174/120 SC

[58] Field of Search ..... 174/32, 36, 110 PM, 174/110 V, 120 SC, 120 SR, 117 F, 117 FF, 117 R, 120 R; 339/17 F, 28, 29 R, 176 MF

[56] References Cited

U.S. PATENT DOCUMENTS

| | | | |
|---|---|---|---|
| 2,628,998 | 2/1953 | Frisbie | 174/117 F X |
| 3,096,210 | 7/1963 | Boonstra | 174/120 SC X |
| 3,602,632 | 8/1971 | Ollis | 174/36 |
| 3,660,592 | 5/1972 | Anderson | 174/36 X |
| 3,707,696 | 12/1972 | Carter | 339/17 F |
| 3,710,007 | 1/1973 | Hoeg et al. | 174/120 SR X |
| 3,735,022 | 5/1973 | Estep | 174/110 V X |
| 3,891,791 | 6/1975 | Schmidt | 174/36 X |

FOREIGN PATENT DOCUMENTS

| | | | |
|---|---|---|---|
| 1083882 | 6/1960 | Fed. Rep. of Germany | 174/117 F |
| 2050913 | 4/1972 | Fed. Rep. of Germany | 174/36 |

*Primary Examiner*—Laramie E. Askin
*Assistant Examiner*—E. F. Borchelt
*Attorney, Agent, or Firm*—Francis W. Young; David M. Carter

[57] ABSTRACT

An improved, very thin flat telephone cable having closely spaced parallel wire pairs surrounded by a plastic jacket, the plastic having processing and mechanical properties of standard jacket material yet being highly conductive relative to standard material, the wire pairs being on centers spaced close enough for gang-termination in standard telephone connectors yet the electrical cross-talk between pairs within the cable or from cable to cable being lower than the cross-talk of a standard, round twisted-pair telephone keyset cable.

36 Claims, 4 Drawing Figures

MULTI-PAIR FLAT TELEPHONE CABLE WITH IMPROVED CHARACTERISTICS

BACKGROUND OF THE INVENTION

The use of flat, multi-wire signal cables is well known in the telephone and electronics industries as a means of electrically interconnecting various kinds of equipment. Among the advantages of flat cable systems are relatively low cost and the ease of gang-terminating the wires of the cable in existing connectors.

In telephone applications, audio frequency cross-talk between circuits must be controlled to very low levels, so that for example a telephone conversation on one line is not heard on another closely spaced line, or interfered with by noise or other signals. In standard round telephone cables, cross-talk is controlled by twisting together the wires of each pair, the various wire pairs being twisted at several different twist periodicities. A discussion of the reduction of cross-talk may be found in "Principles of Electricity Applied to Telephone and Telegraph Work," pages 334–344, published 1961 by the Long Lines Department, American Telephone and Telegraph Company.

There is an important need in several applications for an inexpensive, very thin, flat cable wherein the signal wires are parallel to each other on closely spaced uniform centers for ease of gang-terminating the wires in a connector, yet where the cross-talk is as low or lower than the cross-talk of standard, twisted pair round cable. For example, the telephone keysets in a business office are normally connected to a distribution box by means of 25-pair, band marked distribution (BMD) cable. This kind of cable is standard throughout the telephone industry, is very low in cost and has good cross-talk characteristics throughout the audio and low radio frequency spectrum. However, to terminate BMD cable, each wire, which has its own distinctive color code band, must be visually selected and carefully connected to the respective contact in a distribution box or of a connector, such as the 25-pair "Champ" made by AMP, Inc., or the "Blue Ribbon" made by the Amphenol Co. Needless to say, the labor-cost of terminating BMD cable is appreciable.

Because of the high cost of building construction many office buildings are now being put up without underfloor ducts for telephone cables. As a result the telephone companies have considerable added difficulty in connecting office telephones, and tenants of the building frequently have to put up with unsightly and cumbersome "make-do" wiring running from their telephone keysets to the distribution boxes in the building. One solution to this problem would be to put the telephone wire underneath the office carpeting. However, standard 25-pair BMD cable is four-tenths of an inch thick and is thus not satisfactory for under-carpet installation. An alternative is to use 25 wire pairs twisted and woven or knitted together in a generally flat configuration. But the physical thickness, the cost, and the time of properly terminating the twisted pairs make the use of woven, twisted pair cable not generally acceptable.

Another proposed solution to the problem of obtaining in a flat telephone cable the combined characteristics of low cross-talk, gang-terminability, and minimum thickness is set forth in U.S. Pat. No. 3,764,727 to J. W. Balde of Western Electric Co. In the Balde cable, the conductor pairs are laminated between layers of a thin insulation, such as "Mylar", and are configured in a zig-zag, "pseudotwist" relation for cross-talk control. This cable design gives very good cross-talk control, and gang-terminability of the conductors, but only at selected points along the cable. A modified form of the "pseudotwist" cable is shown in U.S. Pat. No. 3,761,842 to W. B. Gandrud of Bell Telephone Laboratories.

In a recent article by Balde, Delaney and Lahti entitled "Cross-talk Performance of Flat Cable for Telephone Applications", pages 49–58 of *Electronic Packaging and Production*, for May 1976 the authors give cross-talk measurements comparing the Blade "pseudotwist" cable with woven twisted pair cable, standard twisted pair switchboard cable (BMD), plain flat parallel wire cable, and copper shielded flat cable. The authors comment on page 58 that cross-talk reduction of −85 dB for a 10 ft. cable (or −95 dB for 50 ft.) with voice signals is a reasonable limit for acceptable performance. For the sake of completness, some of the data given in this article, as well as other data published by those skilled in the art, will be incorporated hereinafter to give a quantitative comparison of prior telephone cable performance with that of the cable according to the present invention.

In the above Balde et al article, the authors point out several very large potential market applications which presently exist for multi-wire flat telephone cable. They further point out that costs, including cost per foot of cable, are an important factor in determining whether of not a particular flat cable system will be acceptable. They also show that the cost of terminating wires in a telephone cable (depending on the design) can be a considerable part of the installed cost of a system. The estimate that the initial cost of manufacturing the Balde "pseudotwist" cable to be about 5 cents per conductor foot or $2.50 per cable foot for 25 pairs. This cost it should be noted is more than ten times the cost of standard 25-pair BMD cable.

Still another flat cable design for telephone use is described and claimed in U.S. Pat. No. 3,757,029 to J. Marshall, of Ansley Electronics Company, a subsidiary of the Thomas and Betts Company. In this patent and in a subsequent article entitled "Perforance Characteristics of Jacketed Shielded Flat Cable" pages 235–239, in the NEPCON 1973 Proceedings, September 1973, the inventor describes a laminated flat cable which has closely spaced parallel wires and which achieves good cross-talk control by means of copper shields. However, this cable is relatively thick and difficult to terminate, and its cost per cable foot is much greater than the cost of BMD cable of comparable pair count.

From the above discussion it should be evident that there exists an important need for an improved flat telephone cable which at once combines the characteristics of very low manufacturing cost, close parallel wire spacing and very small thickness, excellent cross-talk control, and gang terminability, as well as other mechanical and handling characteristics needed by the telephone industry. The present invention fulfills this need.

SUMMARY OF THE INVENTION

In accordance with the present invention in one particular embodiment thereof, there are provided a multitude of wire pairs which are arranged in a plane parallel to each other on closely spaced centers. They are substantially surrounded by a thin flat plastic jacket of a material which is highly conductive relative to ordinary telephone cable jacket material but which otherwise is substantially the same with regard to processing, flame retardancy, and mechanical characteristics. Each wire of a pair of individually insulated with a thin tough coating of a non-conductive plastic which does not adhere to the conductive jacket, so that the jacket may, when desired, be easily stripped away without baring the wires. The construction of the cable is such that the jacekt material surrounds each pair and holds them together but does not intrude in the space between the two wires of a pair. The center-to-center spacing of the pairs of the cable substantially matches the contact spacing of a standard telephone connector (such as the AMP 25-pair "Champ"). Thus with the cable jacket removed, the individual wires of the cable may be readily gang-terminated in the connector. Since the AMP connector is "insulation displacing", the primary insulation on the wires need not be removed in order to terminate them. A very thin layer of nonconductive plastic may be applied over the conductive plastic jacket for mechanical protection and to electrically insulate the jacket along its length.

Very effective cross-talk reduction in the audio and low radio frequency spectrum is achieved by this unique flat cable design. Another important feature of this new cable is very low cost per foot. This is achieved by a design which permits the cable to be manufactured entirely by extrusion, a process much faster and more economical than laminating for example.

DETAILED DESCRIPTION

Figure 1:
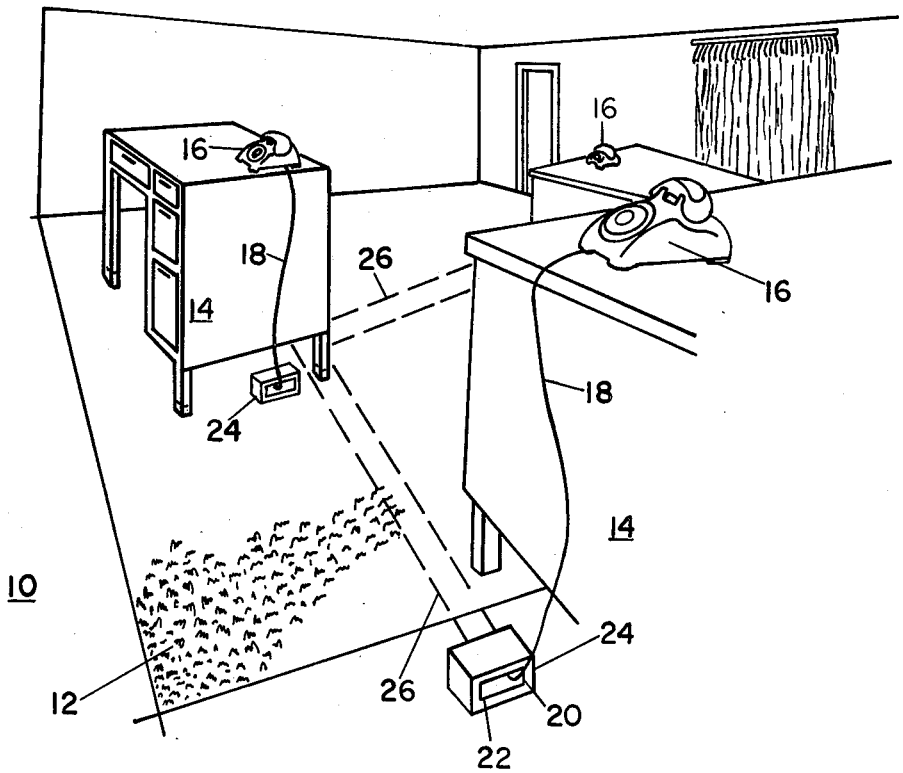
FIG. 1 is an illustrative sketch showing an application wherein flat cables according to the invention are laid undercarpet in a business office and interconnect telephone keysets with a remote distribution box.

The business office 10 shown in FIG. 1 has typical furnishings including wall-to-wall carpet 12 and several desks 14. Located at a convenient place on each desk is a telephone keyset 16, each telephone having a short extension cable 18 the other end of which is terminated by a standard connector 20. The latter is plugged into a mating connector 22 (see also FIG. 2) which is mounted within a junction box 24 and extends through it to receive connector 20. Each box 24 is affixed to the floor over carpet 12 at a location convenient to a desk. Connected within each box 24 to connector 22, and laid underneath carpet 12, is a respective length of a thin flat cable 26 provided according to the invention. The other ends of cables 26 are terminated in a distribution box (not shown).

It should be appreciated that an important advantage of running flat telephone cable under the carpet, aside from eliminating the need for underfloor ducting, is that to rearrange desks 14 and the locations of junction boxes 24, one merely needs to fold back carpeting 12, re-position flat cables 26, and re-fasten junction boxes 24 in their new locations. The narrow slit (through which a cable 26 is passed) put in the carpet at the previous location of each box 24 is easily patched and will be unobtrusive. This is a very important cost saving in rearranging the locations of the telephones in an office.

Figure 2:
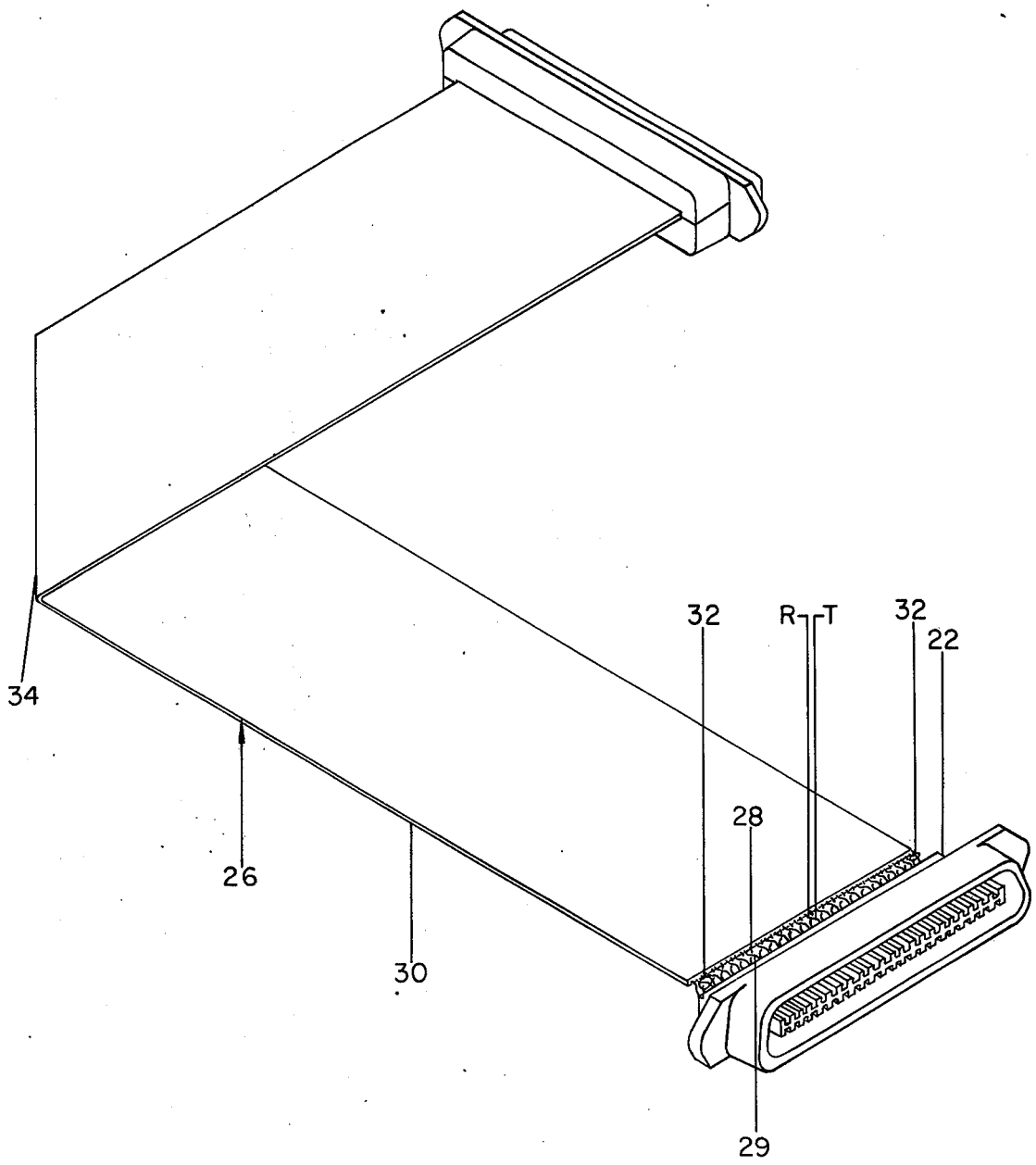
FIG. 2 is an enlarged portion of a cable according to the invention showing how it is gang-terminated in a standard connector, and how the cable may be folded flat upon itself to turn a corner.

As seen in FIG. 2, one end of each cable 26 is gang-terminated in a connector 22 (junction box 24 not being shown). There is a row of closely spaced wire contact elements 28 on the upper side of the connector and a similar row of elements 29 on the opposite side of the connector. Cable 26 contains inside its jacket 30 a number of pairs of wires 32, each wire of a pair being designated "tip" T and "ring" R, respectively, in accordance with standard telephone terminology. Now, there are as many wires T and R in cable 26 as there are contacts in connector 22, the center-to-center spacing of wire pairs 32 being precisely equal to the spacings of connector elements 28 or of elements 29. Thus all of the tip wires T of cable 26 can be easily terminated (without the need for multiple color code selection) in connector elements 28, and all of ring wires R in elements 29. This parallel and precisely spaced arrangement of wires T and R greatly simplifies their gang-termination in connection 22.

As also shown in FIG. 2, cable 26 can be folded flat upon itself at fold 34 to permit the turning of a corner. It is important that cable 26 fold flat without appreciable springback and without damage to wires and insulation. At a fold 34 the cable is twice as thick as elsewhere, and therefore for undercarpet use the thickness of the cable should be kept as small as possible. Moreover since it is possible that a dead weight, such as a leg of a desk 14, will bear through carpet 12 upon cable 26 for a long period of time the materials of the cable should have long-term resistance to plastic creep and cut-through.

Figure 3:
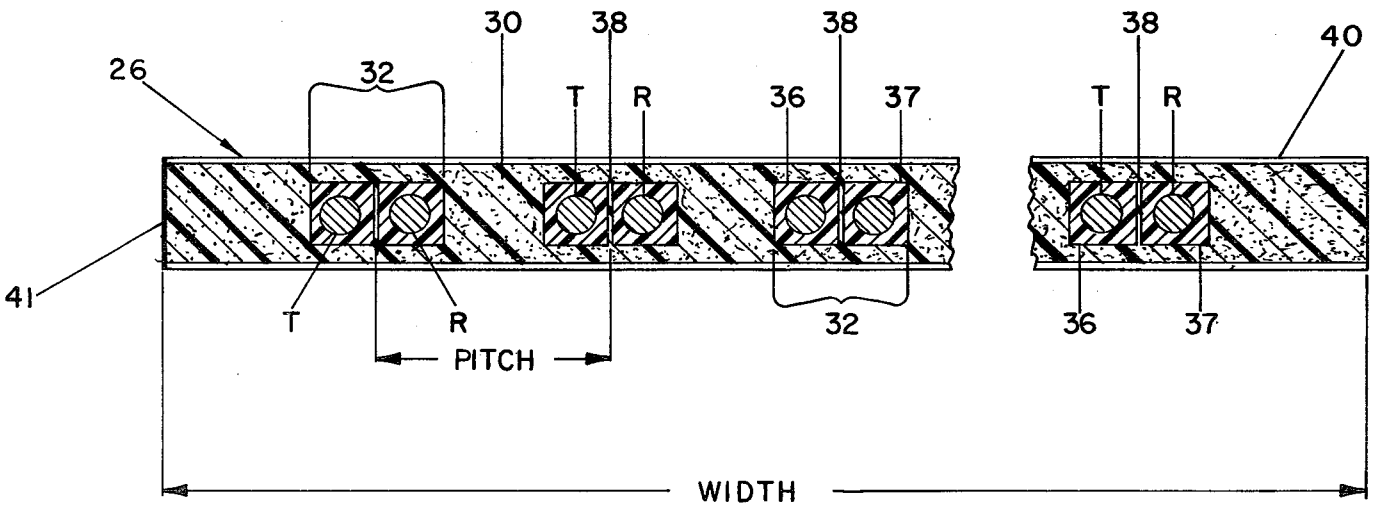
FIG. 3 is a further enlarged cross-section of the cable showing details of its construction.

FIG. 3 shows in enlarged detail the construction of cable 26. Wires T and R which are arranged in pairs 32, are embedded in a thick flat plastic jacket 30. The latter advantageously comprises standard PVC (polyvinylchloride) jacket material, rated FR-1 and modified by the addition of about 10 to 15% by weight of "Ketjenblack" EC carbon black available from Armak Company, Chicago, Ill. Jacket 30 has a volume resistivity in the range of 5 to 100 ohm-cm. It will be recognized that this jacket 30 is highly conductive relative to ordinary PVC cable jackets which typically have volume resistivities of about 10-ohm-cm. Each T and R wire is respectively insulated by a thick covering of insulation 36 and 37 of a tough, extrudable material such as polypropylene. Insulations 36 and 37 are advantageously extruded around each wire with a square outer shape as shown, the insulation 36 of wire T being colored differently from the insulation 37 of wire R. By selecting a material such as polypropylene for insulation 36 and 37, jacket 30 (which is substantially PVC with fillers and additives) can be extruded around the wire pairs 32 without melting their insulation and without adhering thereto. Insulations 36 and 37 are advantageously square as shown so that the insulation wall of wire T and of wire R can be squeezed flat against each other at points 38 during subsequent extrusion of jacket 30. This precludes the conductive plastic of jacket 30 from intruding between the wires of a pair 32 and thereby adversely affecting the electrical transmission properties of that pair. However, jacket 30 substantially fills the space between and around the pairs thereby greatly reducing cross-talk between them within the cable or from cable-to-cable. For further protection of cable 26 jacket 30 may be coated with a very thin, tough layer 40 of a non-conductive plastic. This for example can be a UV curable urethane resin applied as a liquid coating immediately after jacekt 30 is extruded aand then cured by ultra-violet light at the same speed that jacket 30 is extruded. Layer 40 gives added cut-through strength to cable 26 and provides electrical insulation of jacket 30 along its length. A color stripe 41 may be added along one edge of the cable to identify the sequence of wire pairs from left to right.

By way of example, in an actual cable 26 which has been built and tested, the center-to-center spacing or pitch between wire pairs 32 was 0.085 inch, and there were 25 pairs. Each wire T and R was ordinary round, annealed 26 gauge copper wire and insulations 36 and 37 were extruded over their respective wires with square outer sides, each side 0.024 inch wide. The maximum thickness of jacket 30 was approximately 0.036 inch and layer 40 was about 0.001 inch thick. The cable was about 2.25 inches wide and about 0.038 inch thick. Jacket 30 had a volume resistivity of about 10 ohm-cm. Measurements on a substantially identical cable are given in FIG. 4.

Figure 4:
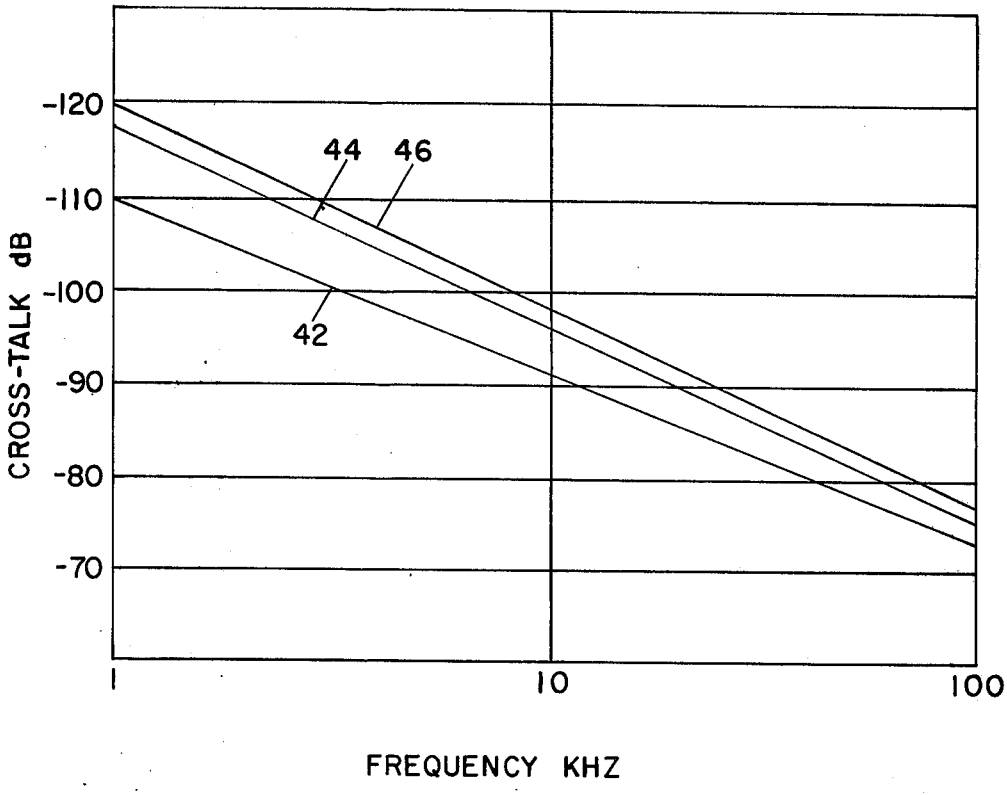
FIG. 4 is a plot of cross-talk versus frequency of standard BMD cable and of a flat cable provided according to the invention.

FIG. 4 is a plot of cross-talk in decibles (dB) versus frequency from 1 KHz to 100 KHz for standard 25-pair BMD cable and for a flat cable 26 (of the same gauge and pair count) made according to the present invention. Measurements were made according to accepted standards, such as described in the Balde et al article referred to previously. They give near-end cross-talk, worst case pair-to-pair values in dB for 50 feet of cable, balanced operation, 600 ohm terminations. As seen in FIG. 4 the lowest curve 42 represents the intra-cable cross-talk measurements on standard 25-pair BMD cable from 1 KHz to 100 KHz. Starting at −110 dB at 1 KHz cross-talk increases to about −73 dB at 100 KHz. The cable-to-cable cross-talk values of BMD cable also lie substantially along curve 42. These figures agree, within the limits of experimental error, with the figures given for switchboard cable (essentially the same as BMD) by W. B. Gandrud of Bell Laboratories in an article entitled "Flat Cable Crosstalk at Audio and Video Frequencies" pages 285–288, of the *Proceedings of the 21st International Wire and Cable Symposium*, December 1972.

Above curve 42 in FIG. 4 is a curve 44 of intra-cable cross-talk measured on 50 feet of cable 26 provided according to the invention. It is evident that cable 26 is superior in cross-talk reduction compared to the industry standard BMD cable. Plotted above curve 44 is yet another curve 46 which gives the worst-case cross-talk from a pair in one 50 foot length of cable 26 to the closest pair in another 50 foot length of cable 26 stacked closely under compression against the first length. Curve 46 shows that at 1 KHz worst case cable-to-cable cross-talk for cable 26 is −120 dB. It will be appreciated by those skilled in the art that the design of cable 26, even with very close pair spacing (e.g. 0.085 inch), achieves a surprising and highly desireable reduction in cross-talk from the audio into the low radio frequency spectrum.

The data in FIG. 4 and data obtained from the Balde et al, and Gandrud articles referred to above, along with other performance criteria, have been summarized in the chart below to compare the cable according to the present invention with the most pertinent, known prior art cables.

CHART

| | | PERFORMANCE AND COST COMPARISONS* | | | | |
|---|---|---|---|---|---|---|
| Cable No. | Cable Type | Intra-Cable Cross-Talk 1 KHz, 50 Ft. | Cable To Cable Cross-Talk 1 KHz, 50 Ft. | Thickness | Rel Labor Cost of Termination | Rel Cost Per Foot |
| 1 | Std 25-pair BMD | −110 dB | −110 dB | 0.4 in. dia. | 5 | 1 |
| 2 | 25-pair twisted woven | −100 to −122 dB | −100 to −115 dB | 0.080 in. | 3 | 2 |
| 3 | Balde "pseudotwist" | −110 to −130 dB | −112 dB | 0.026 in. | 2.5 | >10 |
| 4 | Marshall (Ansley) with copper shields | −104 dB | −95 dB | 0.060 in. | 2.5 | >5 |
| 5 | Flat cable of present invention (FIG. 3) | −118 dB | −120 dB | 0.038 in. | 1 | <1 |

*Further description given in text.

In the chart, there are five cables which are compared, each identified by type and each having been referred to herein. Cross-talk values were obtained for cable No. 1 (std BMD) and for cable No. 5 (the cable according to this invention) from the data of FIG. 4. Cross-talk values for cables No. 2, No. 3 and No. 4 were obtained from the Balde et al and the Gandrud articles. Because of the variations in measurement conditions or dimensions, ranges of cross-talk values are reported for cables No. 2 and No. 3. Thicknesses given in the chart are based on actual measurements in inches. The relative labor costs of terminating the various cables are normalized values based on average time taken. Thus Cable No. 5 takes one unit of "time-cost", whereas cable No. 1 No. 2, requires 5 units. The relative cost per foot of cable for cables No. 1, No. 5 are based on known factory standard costs which have been normalized, with the cost of cable No. 1 (which is an industry standard) given as one unit. The costs of cable No. 3 and cable No. 4 were obtained from the Balde et al article, and from estimates made by persons skilled in the art of making flat cable.

A study of the chart makes clear that of all the cables listed, a cable according to this invention (cable No. 5) is substantially the lowest in cross-talk, next to the thinnest, the least expensive to terminate, and less costly per foot than the other cables.

The above description is intended in illustration and not in limiatation of the invention. Various changes or modifications in the embodiment given may occur to those skilled in the art and can be made without departing from the spirit or scope of the invention as set forth.

I claim:

1. A mutli-pair flat telephone cable comprising: a plurality of closely spaced parallel pairs of wires, tough thin-wall insulation surrounding each wire, and a thin flat plastic jacket substantially surrounding the insulation members of each pair and holding said pairs in generally flat parallel relation to each other on centers substantially equal to the contact spacing of a telephone connector, said jacket having substantially the processing and mechnical properties of telephone cable jacket insulation material but having a resistivity millions of times lower than that of cable jacket insulation material, said jacekt including a conductive material in such an amount for substantially reducing the electrical cross-talk from pair-to-pair within said cable said jacekt further providing mechanical protection for said pairs.

2. The cable in claim 1 wherein said jacket has a volume resistivity of less than about 100 ohm-centimeters.

3. The cable in claim 1 wherein said jacekt is comprised of PVC with fillers and additives including a small percentage of highly conductive carbon black.

4. The cable in claim 3 wherein the carbon black amounts to roughly 10% by weight of the PVC.

5. A low cost, low-cross talk, very thin flat multi-pair cable assembly comprising: a plurality of wire pairs which are closely spaced on parallel centers, each pair including a tip wire and a ring wire, said wires being covered by a thin tough insulating plastic, the wires of the pair being closely spaced parallel to each other, a thin covering over said wires and holding them in a paired spaced relation, said covering at least in part being a plastic, said covering including a conductive material in such an amount so that said covering has a volume resistivity less than about 100 ohm-centimeters, and a multi-pin telephone connector gang-terminated to the respective wires of said cable, said cable covering in the vicinity of said connector being removed, there being at least a portion of the insulation plastic of said wires extending beyond the conductive part of said covering, the spacing of said pairs substantially matching the spacing of the contacts of said connector.

6. A low cost flat signal cable having greatly reduced cross-talk, said cable comprising a plurality of pairs of wires on closely spaced parallel centers, said wires being insulated with a primary insulation that is thin and tough, and a flat plastic jacket extruded about said pairs of wires and holding them in uniformly spaced relation, said jacket at least in part including a conductive material in such an amount for providing a volume resistivity less than about 100 ohm-centimeters, said jacket substantially not melting and not adhering to said primary insulation, whereby said jacket can easily be removed from said wire pairs positioned for gang termination in a connector.

7. The cable in claim 6 wherein each of said wires in a pair is individually insulated with said primary insulation, the insulation of one wire being colored differently from the other.

8. The cable in claim 6 wherein said wires are standard round telephone wire, each wire having extruded over it a respective primary insulation, the outer sides of which are generally square, said wires of a pair lying with their insulation sides flat against each other and being held in spaced pair-to-pair relation by said jacket.

9. The cable in claim 6 wherein said jacket is a PVC compound with fillers and additives, said compound having a modest percentage by weight of conductive carbon black, said primary insulation being a polyolefin.

10. The cable in claim 6 wherein said wires are standard round telephone wire, each wire having extruded over it a respective primary insulation, a portion of the insulation of a wire in a pair abutting against a portion of the insulation of the other wire in said pair whereby the region between wires in a pair is substantially void of conductive material.

11. A low cost flat telephone cable having improved cross-talk and gang terminating characteristics, said cable comprising a plurality of wire pairs on closely spaced parallel centers which substantially match the contact spacing or pitch of a standard 25-pair telephone connection, each wire of a pair being round and insulated by a thin tough primary insulation and held in a very close parallel relation to the other wire of the pair by said insulation, each wire of a pair being readily separated from the other for ease of termination, and a thin flat plastic jacket extending over and between said wire pairs, said jacekt including a conductive material in such amount such that said jacket has a volume resistivity of about 5 to 100 ohm-centimeters, said jacket providing mechanical protection and cross-talk control for said pairs, said jacket and said pairs being readily separated from each other for ease of termination in a connector.

12. The cable in claim 11 wherein said jacket has roughly 10% by weight of a highly conductive carbon black, said jacket being extruded around said wire pairs, said jacket having a thin tough outer covering of an insulating material for added cut-through resistance.

13. The cable in claim 11 wherein all of said wires and wire pairs lie substantially in the same plane, the thickness of said jacket and wire pairs being only slightly more than the thickness of said pairs and their primary insulation, said cable being foldable flat upon itself and having long term resistance to cut-through under a dead weight load.

14. An electrical communication cable comprising: at least two pairs of substantially parallel conductors, at least one of said conductors adapted to receive electrical communication signals, electrical insulation disposed around each of said conductors, a material including at least two components substantially surrounding each of said pairs, one of said components being electrically conductive and provided in such an amount so as to substantially reduce cross-talk between said pairs while an electric communication signal is on said at least one conductor.

15. A cable as set forth in claim 14 wherein the conductors in said pairs of conductors correspond to the tip and ring conductors of a telephone system; said conductors adapted to receive signals between 1 Hz and 100 Hz frequencies.

16. A cable as set forth in claim 14 wherein the region between the conductors in a pair is substantially free of said conductive material.

17. The cable as set forth in claim 14, further including a layer of insulation substantially surrounding said material.

18. A cable as set forth in claim 14 wherein said material is extruded around and between said pairs of conductors.

19. A cable as set forth in claim 14 wherein said material is laminated over the top and bottom of said pairs of conductors.

20. A cable as set forth in claim 14 wherein said material has the mechanical property to provide substantial fixed spacing between pairs of conductors whereby said cable may be readily gang-terminated to a connector.

21. The cable as set forth in claim 14 wherein said one component of said material is electrically conductive carbon black and the other component is a plastic-like substance.

22. A cable as set forth in claim 21 wherein said plastic-like substance includes polyvinylchloride.

23. A cable as set forth in claim 21 wherein the amount of said conductive carbon black ranges between 10% and 15% by weight of said material.

24. A cable as set forth in claim 14 wherein said material has a D.C. electric resistivity of less than 100 ohms-centimeter.

25. A cable as set forth in claim 24 wherein said material has a D.C. electric resistivity in the range between 5 and 20 ohms-centimeter.

26. A cable as set forth in claim 14 including electric insulation for each individual conductor, said insulation being in the form of a four-sided configuration, each of said insulated conductors in a pair being abutted against one another to substantially prevent the conductive material from seeping between said individual conductors in a pair.

27. A cable as set forth in claim 14 wherein said insulation about each conductor and said material are not bonded together whereby said material is readily stripped from the end of said cable.

28. A cable as set forth in claim 27 wherein said insulation about each conductor includes polypropylene and said material includes polyvinylchloride.

29. An electric communication cable comprising: at least two pairs of parallel conductors, at least one of said conductors adapted to receive electric communication signals, electric insulation disposed around each of said conductors, a semi-conductive mixture including at least two components, one of said components being electrically conductive, said mixture substantially surrounding said pairs of conductors for substantially reducing cross-talk between said pairs while an electrical communication signal is on at least one of said conductors.

30. An electric communication cable comprising: a plurality of pairs of substantially parallel conductors, at least one of each conductor in an individual pair being coplanar with an adjacent conductor of another pair, each of said conductors having electrical insulation thereabout, a mixture of conductive carbon black and a filler, said mixture substantially surrounding said insulated pairs of conductors, said insulation about each conductor providing a barrier to said mixture, such that the mixture cannot substantially exist between the conductors of an individual pair, a further layer of insulation surrounding said mixture for preventing electric discharge and mechanical toughness.

31. A cable as set forth in claim 30 whereby said conductive mixture has a volume resistivity in a range of from less than 100 ohms-cm. for 15% loading by weight of said carbon black to $10^4$ ohms-cm. for 5% loading.

32. A cable as set forth in claim 30 wherein said carbon black is at least 15% by weight of the total mixture.

33. A substantially flat electrical communication cable comprising: a plurality of pairs of parallel spaced apart insulated conductors; a layer of semi-conductive plastic material substantially surrounding each of said pairs of insulated conductors; said material providing fixed spacing between said pairs and being sufficiently conductive for reducing cross-talk between said pairs; said material further providing mechanical flexibility for said cable.

34. A cable as set forth in claim 33 wherein said layer of semi-conductive plastic includes a mixture of conductive carbon black and polyvinylchloride.

35. An electrical communication cable comprising: at least two pairs of substantially parallel conductors; electrical insulation disposed around each of said conductors; a semi-conductive plastic-like material substantially surrounding said pairs; said material being sufficiently conductive for substantially reducing cross-talk between pairs of conductors while an electric communication signal is on one of said conductors.

36. A cable as set forth in claim 35 wherein the D.C. resistivity of said material is less than 100 ohms-centimeter.

* * * * *

UNITED STATES PATENT OFFICE
CERTIFICATE OF CORRECTION

Patent No. 4,155,613 Dated May 22, 1979

Inventor(s) Edward P. Brandeau

It is certified that error appears in the above-identified patent and that said Letters Patent are hereby corrected as shown below:

In Column 2, Line 32, delete "The" and insert therefor --They--.

In Column 3, Line 3, delete "of" and insert therefor --is--.

In Column 3, Line 8, correct the spelling of "jacket".

In Column 4, Line 47, delete "$10^{-}$" and insert therefor --$10^{14}$--.

In Column 5, Line 4, correct the spelling of "jacket" and "and".

In Column 7, Lines 5, 7 and 12, correct the spelling of "jacket".

Signed and Sealed this

First Day of September 1981

[SEAL]

Attest:

GERALD J. MOSSINGHOFF

Attesting Officer

Commissioner of Patents and Trademarks